US006189871B1

(12) United States Patent
Schlageter et al.

(10) Patent No.: US 6,189,871 B1
(45) Date of Patent: Feb. 20, 2001

(54) STEAM INTRODUCTION DEVICE IN A POWER PLANT

(75) Inventors: Rainer Schlageter, Albbruck (DE); Vaclav Svoboda, Birmensdorf (CH)

(73) Assignee: Asea Brown Boveri AG, Baden (CH)

( * ) Notice: Under 35 U.S.C. 154(b), the term of this patent shall be extended for 0 days.

(21) Appl. No.: 09/299,647

(22) Filed: Apr. 24, 1999

(30) Foreign Application Priority Data

Apr. 30, 1998 (EP) ..... 98810384

(51) Int. Cl.[7] ..... B01F 3/04
(52) U.S. Cl. ..... 261/78.2; 261/118; 261/DIG. 13
(58) Field of Search ..... 261/78.2, 115, 261/118, 100, 102, 152, DIG. 10, DIG. 13

(56) References Cited

U.S. PATENT DOCUMENTS

| | | | | |
|---|---|---|---|---|
| 1,473,449 | * | 11/1923 | Sterans et al. | 261/DIG. 13 |
| 1,773,054 | * | 8/1930 | McDermot | 261/DIG. 13 |
| 2,091,664 | * | 10/1937 | Monohan | 261/DIG. 13 |
| 3,287,001 | * | 11/1966 | Harris | 261/118 |
| 3,318,589 | * | 5/1967 | Herp, Jr. | 261/DIG. 13 |
| 3,732,851 | * | 5/1973 | Self | 261/DIG. 13 |
| 3,981,946 | * | 9/1976 | Soya et al. | 261/118 |
| 4,278,619 | * | 7/1981 | Tiefenthaler | 261/118 |
| 4,474,477 | * | 10/1984 | Smith et al. | 261/118 |
| 5,338,496 | | 8/1994 | Talbot et al. . | |
| 5,385,121 | * | 1/1995 | Feiss | 261/DIG. 13 |
| 5,558,819 | * | 9/1996 | Den Hollander | 261/116 |

FOREIGN PATENT DOCUMENTS

| | | |
|---|---|---|
| 0108298 | 5/1984 | (EP) . |
| 57-049004 | 3/1982 | (JP) . |
| 08303209 | 11/1996 | (JP) . |

OTHER PUBLICATIONS

"Exploit turbine bypass systems for improvements in operation", Kueffer, Power, Oct. 1990, pp. 71–74.

"Stand der Technik bei Dampfumformventilen", Kueffer, VGB Kraftwerkstechnik 73, 1993 pp. 947–953.

"Auslegung und Konzept des Niederdruck–Umleitsystems", Nabholz, BBC Brown Boveri, pp. 3–7, No Date.

* cited by examiner

*Primary Examiner*—Duane S. Smith
(74) *Attorney, Agent, or Firm*—Burns, Doane, Swecker & Mathis, L.L.P.

(57) ABSTRACT

In a steam power plant, a bypass line (2), which serves for diverting steam during the startup or rundown of the power plant, is arranged between the boiler and condenser (9). Arranged in the bypass line (2), upstream of the condenser (9), is a steam introduction device (1), in which the steam, before being introduced into the condenser (9), is expanded and cooled. The steam introduction device (1) has a first perforated diaphragm (3), a cooling chamber (4) and a second perforated diaphragm (8). According to the invention, the first perforated diaphragm (3) consists of a single spherical part. By virtue of this shape, the perforated diaphragm (3) possesses favorable mechanical and thermal stability, with the result that it becomes possible to have small wall thicknesses and production by pressing. After pressing, the orifices (12) in the perforated diaphragm are made by once-only drilling and are in each case at an equal distance from the orifices next to them. The perforated diaphragm (3) is distinguished by increased operating reliability and lower fabrication costs.

7 Claims, 3 Drawing Sheets

STEAM INTRODUCTION DEVICE IN A POWER PLANT

BACKGROUND OF THE INVENTION

1. Field of the Invention

The invention relates to a steam power station with a boiler, a steam turbine, a condenser and a bypass line which bypasses the steam turbine by leading directly from the boiler to the condenser. It relates, in particular, to a steam introduction device between the bypass line and the condenser and to the first of two steam passage diaphragms in this steam introduction device.

2. Discussion of Background

During the startup and rundown of a steam power plant and during steam turbine load shedding due to a shutdown of the plant, the steam is not led from the boiler to the steam turbine, since said steam contains too much water and would consequently damage the turbine blading. Instead, the steam is led directly from the boiler into the condenser through a bypass line and a steam introduction device. The steam introduction device serves for expanding the steam and cooling it before it enters the condenser for condensation. The steam flowing in via the bypass line has, on the one hand, a high flow velocity and, on the other hand, a temperature of up to 600° C. By contrast, the temperature prevailing in the condenser is around 40° C. It is therefore expedient to lower the temperature of the steam and its velocity sharply. This also means that the components of the steam introduction device are exposed to a high temperature gradient.

According to publication number CH-T 080 273 of the Brown Boveri Companie, a bypass regulating valve is followed by a two-stage steam introduction device which is arranged in the condenser. The first stage of the steam introduction device consists of a steam passage diaphragm, specifically a perforated diaphragm which is frustoconical and by means of which the hot steam stream is sprayed and fanned out. Downstream of the perforated diaphragm, the latter enters an expansion or cooling chamber. Here, it is cooled by means of cool condensate which is sprayed into the fanned-out steam stream by a plurality of nozzles. In the second stage of the steam introduction device, the steam flows through a second perforated diaphragm, by means of which the steam is distributed in the condenser neck and over the cooling tubes of the condenser.

A perforated diaphragm of the first stage of the steam introduction device is manufactured from a plurality of plane components, specifically a part for the envelope of the cone frustum, a closure part for the vertex of the cone and a transitional part for connection to the end of the bypass line. The orifices in the perforated diaphragm are drilled into the still plane part of the cone envelope, said part subsequently being hot-formed into a cone and welded together. The closure part for the vertex of the cone is then welded to the cone frustum and the transitional part is welded to the end of the bypass line.

In order to ensure that the cone, which has a multiplicity of drilled orifices, has sufficient mechanical stability, relatively large wall thicknesses are necessary. The larger the wall thickness, the higher the thermal stresses. As mentioned, this perforated diaphragm is exposed to a very high temperature gradient. During use, therefore, the considerable temperature gradient from one side of the perforated diaphragm to the other leads, in the case of large wall thicknesses, to correspondingly high thermal stresses, with the result that cracks may form in the material. As early as during the hot-forming process, too, small cracks may form, and these may subsequently increase in size during operation and ultimately lead to a material fracture. Such susceptibility to cracks or fractures is detrimental to the operating reliability of the power plant, since damage to the perforated diaphragm can be rectified only by a repair, with the entire plant being shut down. Furthermore, the cost-intensive production of the perforated diaphragm is a disadvantage. On the one hand, the manufacture of the plurality of individual parts and the welding work for assembling these necessitate a high outlay in terms of fabrication and cost. On the other hand, while the perforated diaphragm is being formed into the cone, the geometry of the drilled orifices is distorted, so that, where appropriate, the orifices have to be remachined.

SUMMARY OF THE INVENTION

Accordingly, one object of the invention is to provide a novel perforated diaphragm for a steam introduction device in the bypass line of a steam power plant, said device possessing increased operating reliability due to improved thermal stability and necessitating a lower outlay in terms of fabrication and cost, as compared with the prior art described.

The object is achieved by means of a steam introduction device having a perforated diaphragm of which consists of a single spherical part.

The main advantage of a perforated diaphragm of this type is the increased mechanical stability and thermal load-bearing capacity of the perforated diaphragm and the consequently achieved operating reliability of the steam introduction device. The operating reliability of the entire power plant is also increased thereby, since a longer operating time of the device without any repairs is ensured.

As compared with a conical shape, a spherical shape is mechanically more stable per se. The selected shape of the diaphragm thus affords increased mechanical stability, as compared with the prior art. By virtue of this increased shape-induced stability, the diaphragm according to the invention has a smaller wall thickness than the conical diaphragm, the stability necessary for the diaphragm being nevertheless ensured. Moreover, a smaller wall thickness affords the advantage that the thermal stresses in the material, which are caused by the temperature gradient, are lower. As a result, the thermal load-bearing capacity is appreciably increased and the susceptibility of the diaphragm to fractures is reduced.

In a preferred version, the orifices of the perforated diaphragm are arranged in such a way that each orifice is equidistant from each orifice next to it. This likewise brings about a uniform material thickness and thermal stability of the diaphragm.

The one-part spherical diaphragm is produced by means of a pressing operation. After the desired shape has been obtained, the workpiece is reannealed and is cooled and stress-relieved in a controlled manner. The final product has minimal material stresses due to this method of manufacture, this being conducive to the thermal load-bearing capacity of the diaphragm during operation.

A second advantage is the reduction in the cost of fabricating the perforated diaphragm. This is achieved primarily by the reduction in the number of parts to a single part and in the number of machining steps. Only one pressing operation is necessary in order to manufacture the diaphragm, and welding operations are no longer required. There is no need for the separate manufacture and fitting of a closure part, as was the case with the conical perforated diaphragm, or, in particular, also of a transitional piece between the perforated diaphragm and the end of the bypass line. The spherical perforated diaphragm has a straight rim, the diameter of which is adapted to the diameter of the bypass line. During assembly, the perforated diaphragm is welded directly onto the end of the bypass line without the aid of a separately manufactured transitional piece.

Finally, the drilling of the orifices in the perforated diaphragm is carried out by means of a numerically controlled machine after the operation of pressing the diaphragm. Remachining of the orifices, as in the prior art, is no longer necessary, thereby avoiding further outlay in terms of fabrication.

BRIEF DESCRIPTION OF THE DRAWINGS

A more complete appreciation of the invention and many of the attendant advantages thereof will be readily obtained as the same becomes better understood by reference to the following detail description when considered in connection with the accompanying drawings, wherein.

DESCRIPTION OF THE PREFERRED EMBODIMENTS

Figure 1:
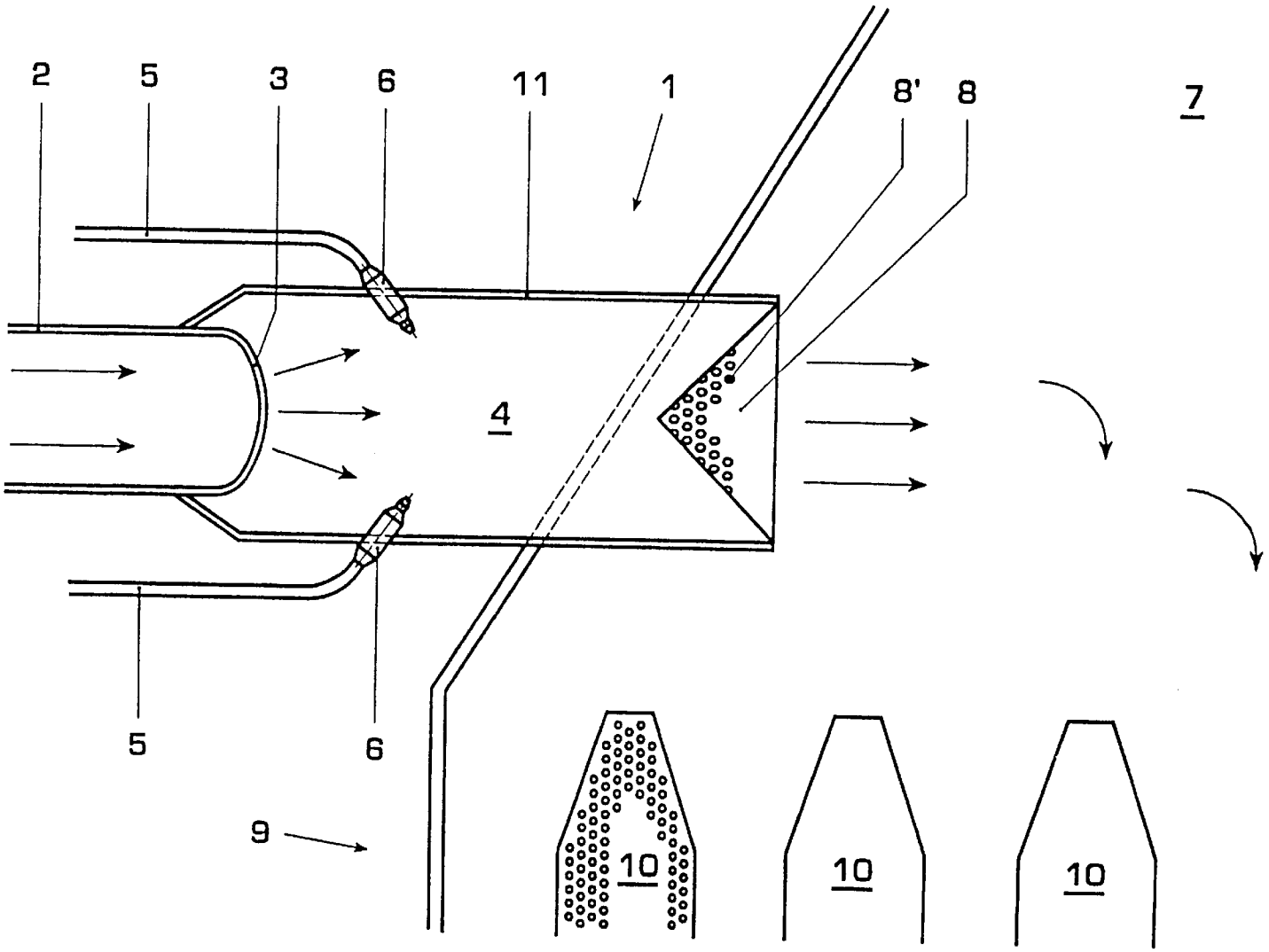
FIG. 1 shows a bypass line connected to a steam introduction device and to a condenser.

Referring now to the drawings, wherein like reference numerals designate identical or corresponding parts throughout the several views, FIG. 1 shows a cross section through a stream introduction device 1 in a steam power plant. A bypass line 2 leads from a plant boiler, not illustrated, to the steam introduction device 1. The latter is connected to the condenser 9 and projects into the condenser neck 7 of the latter. During the startup or rundown or a brief shutdown of the power plant, hot steam is led in the direction of the arrows from the boiler at a temperature of above 500° C. through the bypass line 2, whereupon it strikes a first perforated diaphragm 3 of the steam introduction device. The steam passes through orifices in the perforated diaphragm 3 and is thereby fanned open. The purpose of the perforated diaphragm is to broaden the steam stream to as great an extent as possible, so that it fills the following cooling chamber 4 as much as possible. The cooling chamber 4 includes a wall 11. Arranged in the cooling chamber 4 are a plurality of nozzles 6 which inject cool condensate in the form of water drops into the chamber through the condensate feed lines. Here, the steam is cooled by being intermixed with the water. In addition to cooling, the steam is expanded in the chamber as a result of swirling. At the end of the cooling chamber 4, the steam passes through the orifices 8' of a second perforated diaphragm 8. This second perforated diaphragm 8 has a semicylindrical shape, the cylinder projecting into the plane of the drawing and projecting out of the plane of the drawing. The perforated diaphragm 8 brings about a regular distribution of the cooled steam in one plane in the condenser neck 7 above the tube bundles 10. The steam is sucked out of this plane into the condenser 9 and condensed on the cooling tubes in the tube bundles 10.

Figure 2:
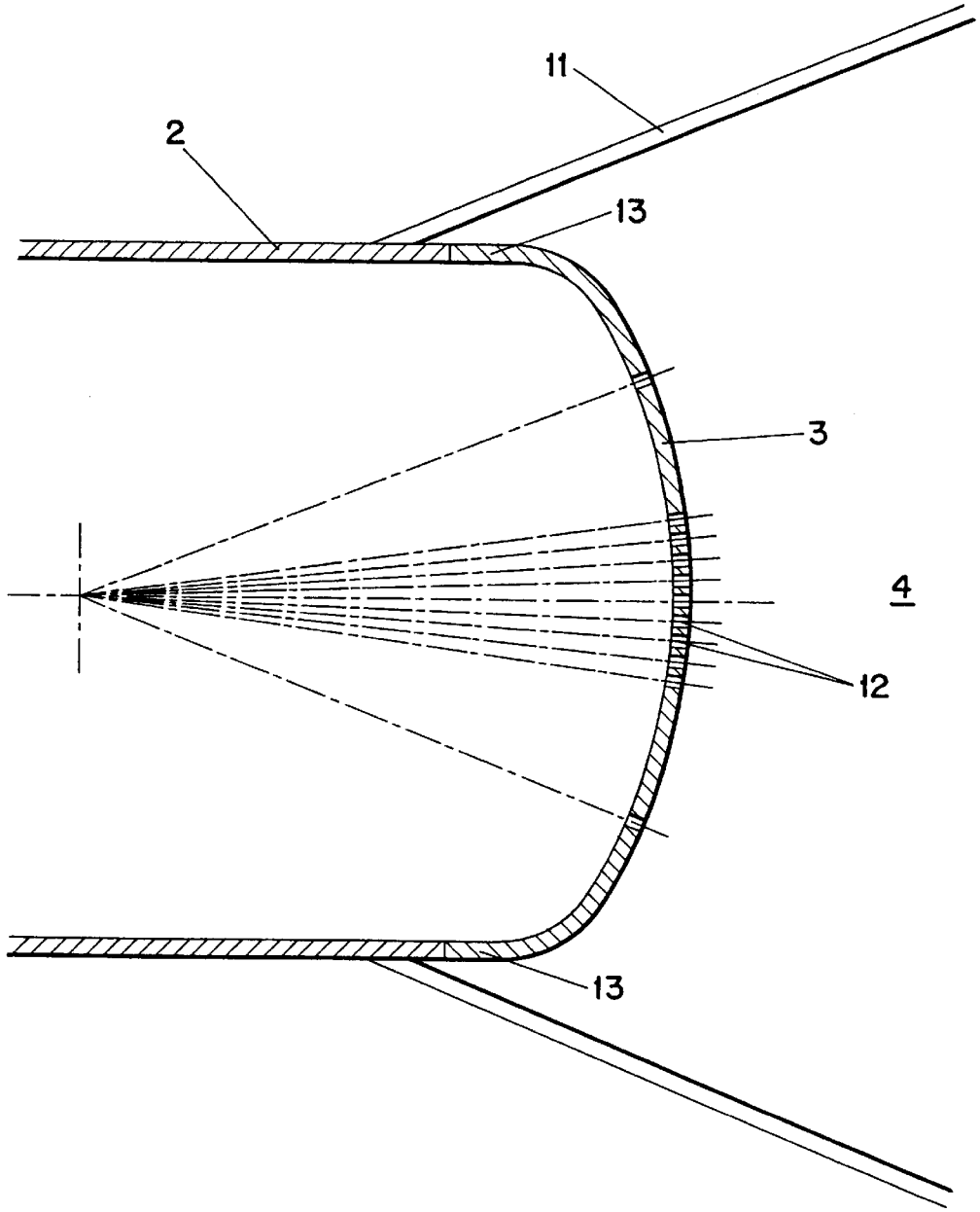
FIG. 2 shows the perforated diaphragm according to the invention of the steam introduction device in detail.
Figure 3:
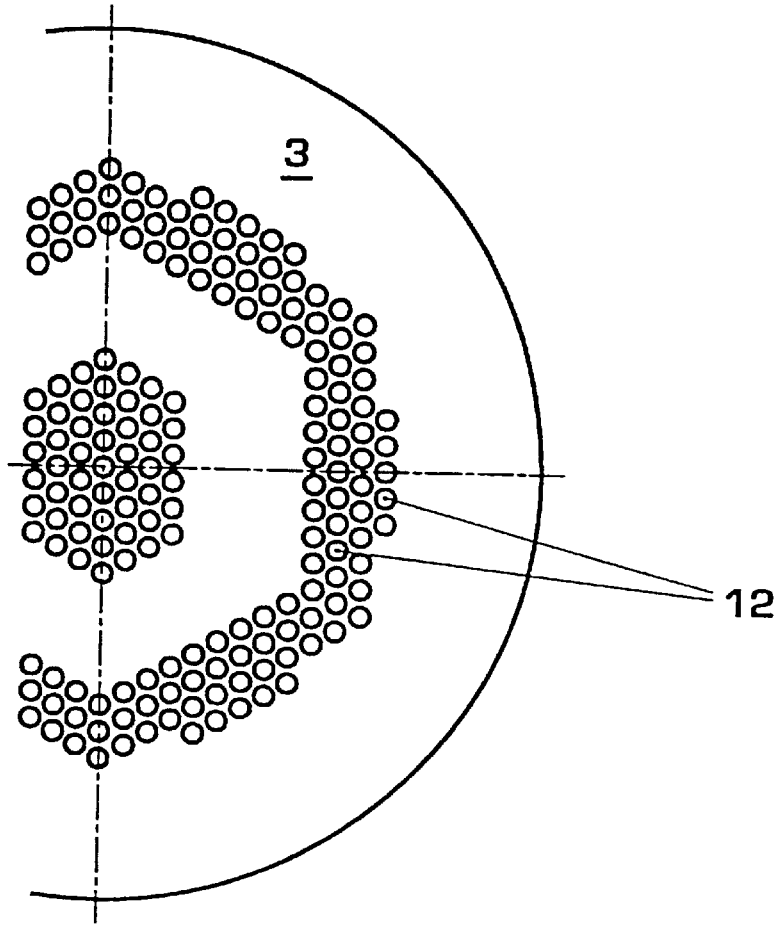
FIG. 3 shows a front view of the perforation geometry of the perforated diaphragm according to the invention.

FIG. 2 shows the first perforated diaphragm 3 according to the invention in detail. In this version, the perforated diaphragm 3 is in the shape of the bottom of a three-center curve. This shape is also known, for example, under German Industrial Standard number 28013. It is distinguished, in particular, by the spherical middle part, the diaphragm thereby possessing increased mechanical stability. It is therefore designed with thinner walls and nevertheless has the necessary stability. The three-center curve bottom with the straight rim 13 is produced in a single pressing operation. After the pressing operation, the orifices 12 are drilled by means of a programmable drilling machine (numerically controlled machine) operating on five axes. This machining method ensures that the axes of the orifices 12 in each case intersect at the same center point. This orientation of the orifices 12 ensures that the steam stream is fanned open more uniformly. The straight rim 13 of the three-center curve bottom is welded directly onto the end of the bypass line 2. The arrangement of the drilled orifices 12 in the perforated diaphragm 3 according to the invention is shown in FIG. 3. Said arrangement is distinguished in that the distance between adjacent orifices 12 is in each case the same. This is conducive to mechanical stability over the entire surface of the diaphragm. In this case, the coordinates of the orifices are calculated according to the curvature of the three-center curve bottom and the necessary diameters of the orifices and are fed directly to the numerically controlled machine for manufacture.

By virtue of the spheric shape of the perforated diaphragm, the latter projects a shorter distance into the cooling chamber than a conical perforated diaphragm. The advantage of this is that water drops, which are located in the condensate line after the condensate nozzles 6 have been switched off and which fall into the cooling chamber, do not impinge onto the hot perforated diaphragm. Such drops would otherwise cause a local thermal shock and, possibly, result in erosion of the diaphragm.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A steam introduction device in a power plant, with a bypass line which leads from a boiler to a condenser, the steam introduction device being arranged in the bypass line and upstream of the condenser neck and having a cooling chamber, a first perforated diaphragm at the start of the cooling chamber, a second perforated diaphragm at the end of the cooling chamber and a plurality of nozzles for the purpose of injecting cooling condensate into the cooling chamber, wherein the first perforated diaphragm at the start of the cooling chamber consists of a single spherical part.

2. The steam introduction device as claimed in claim 1, wherein the first perforated diaphragm is in the shape of the bottom of a three-center curve.

3. The steam introduction device as claimed in claim 1, wherein the first perforated diaphragm has a straight rim, the diameter of which is adapted to that of the bypass line.

4. The steam introduction device as claimed in claim 3, wherein the first perforated diaphragm has orifices which are at an equal distance from all the orifices next to them.

5. The steam introduction device as claimed in claim 4, wherein the axes of all the orifices intersect at one point.

6. The steam introduction device as claimed in claim 5, wherein the first perforated diaphragm is welded onto the end of the bypass line.

7. The steam introduction device as claimed in claim 6, wherein the end of the first perforated diaphragm is at a distance from the nozzles, so that the perforated diaphragm remains free of water drops which fall out of the closed nozzles.

* * * * *